US005506467A

United States Patent [19]

Nishimura et al.

[11] Patent Number: 5,506,467

[45] Date of Patent: Apr. 9, 1996

[54] CATHODE-RAY TUBE AND METHOD OF MANUFACTURING THE SAME

[75] Inventors: Takashi Nishimura; Kazuyuki Seino, both of Fukaya; Tohru Takahashi, Kumagaya; Yuuji Haraguchi; Eiji Kamohara, both of Fukaya, all of Japan

[73] Assignee: Kabushiki Kaisha Toshiba, Kawasaki, Japan

[21] Appl. No.: 273,938

[22] Filed: Jul. 12, 1994

[30] Foreign Application Priority Data

| | | | |
|---|---|---|---|
| Jul. 13, 1993 | [JP] | Japan | 5-172897 |
| Jul. 13, 1993 | [JP] | Japan | 5-172898 |
| Jun. 13, 1994 | [JP] | Japan | 6-129383 |

[51] Int. Cl.[6] ..... H01J 31/20

[52] U.S. Cl. ..... 313/408; 313/496; 313/402; 313/2.1

[58] Field of Search ..... 313/495, 496, 313/497, 2.1, 402, 408, 422, 476, 482

[56] References Cited

U.S. PATENT DOCUMENTS

| | | | |
|---|---|---|---|
| 3,071,706 | 1/1963 | Waldorf . | |
| 4,608,518 | 8/1986 | Fukuda et al. | 313/495 |
| 5,365,143 | 11/1994 | Nishimura et al. | 313/402 |

FOREIGN PATENT DOCUMENTS

| | | |
|---|---|---|
| 0548467 | 6/1993 | European Pat. Off. . |
| 48-90428 | 11/1973 | Japan . |
| 5-36363 | 2/1993 | Japan . |
| 5242826 | 9/1993 | Japan . |

OTHER PUBLICATIONS

Patent Abstracts of Japan, vol. 3, No. 38 (E-101) Mar. 30, 1979 & JP-A-54 016 172 (Toshiba Corp) Feb. 6, 1979.
Patent Abstracts of Japan, vol. 17, No. 319 (E-1383) Jun. 17, 1993 & JP-A-05 036 363 (Toshiba Corp) Feb. 12, 1993.
Patent Abstracts of Japan, vol. 17, No. 698 (E-1481) Dec. 20, 1993 & JP-A-05 242 826 (Toshiba Corp) Sep. 21, 1993.

*Primary Examiner*—Donald J. Yusko
*Assistant Examiner*—Nimesh Patel
*Attorney, Agent, or Firm*—Cushman Darby & Cushman

[57] ABSTRACT

A color cathode-ray tube comprises an envelope having rectangular flat face and rear plates opposing each other. A phosphor screen is formed on an inner surface of the face plate. Mask support members are mounted on an inner surface of the rear plate. A shadow mask is arranged in the envelope and supported by the mask support members to face the phosphor screen at a predetermined distance. A plurality of positioning posts are fixed on the inner surface of the rear plate and extend toward the face plate. A plurality of positioning pins extend from the inner surface of the face plate and engage the positioning posts so as to position the face plate at a predetermined position with respect to the rear plate. The shadow mask has setting openings through which the positioning posts extend so as to position the shadow mask at a predetermined position with respect to the rear plate.

14 Claims, 9 Drawing Sheets

CATHODE-RAY TUBE AND METHOD OF MANUFACTURING THE SAME

BACKGROUND OF THE INVENTION

1. Field of the Invention

The present invention relates to a color cathode-ray tube in which a phosphor screen is formed on the inner surface of a flat face plate, and a method of manufacturing the same.

2. Description of the Related Art

Recently, various researches have been made on high-definition broadcasting and a high-resolution cathode-ray tube with a large screen designed for the high-definition broadcasting. In general, in order to achieve high resolution of a cathode-ray tube, the spot diameter of an electron beam on a phosphor screen must be reduced.

For this purpose, in the prior art, the structure of an electrode of an electron gun has been improved, or the caliber and/or length of the electron gun has been increased. However, satisfactory achievement has not been obtained. The main reason for the failure is that the distance between the electron gun and the phosphor screen increases in accordance with increases in the size of the tube and increases in the magnification of the electron lens. Accordingly, in order to achieve high resolution, it is important to shorten the distance (depth) between the electron gun and the phosphor screen. In addition, when the wide-angle deflection is used, the difference in magnification between the center area and peripheral area of the phosphor screen increases. Thus, the wide-angle deflection is not advantageous for achieving high resolution.

Jpn. Pat. Appln. KOKAI Publication No. 48-90428 discloses a method of arranging a plurality of independent small-sized cathode-ray tubes, thereby constituting a high-resolution, large screen. This kind of method is effective for large-scale screen display with a large number of divided regions, which is designed for outdoor installation. However, when this method is applied to middle-scale screen display (e.g., the screen size is about 40 inches), connection portions between the divided regions of the screen are conspicuous, resulting in low-quality images. Thus, when the display formed by this method is used a household TV receiver or computer-aided design (CAD), the connection portions on the screen are a serious defect.

On the other hand, U.S. Pat. No. 3,071,706 or the like discloses a structure wherein phosphor screens of a plurality of independent cathode-ray tubes are integrated. In this cathode-ray tube having the integrated phosphor screen, a vacuum envelope is constituted by a face plate on which a phosphor screen is coated, a rear plate opposed and arranged to the face plate, and a plurality of funnels adjacent to the rear plate.

With this structure, however, if the screen surface becomes broader, it is necessary to increase the thickness of the face plate or rear plate in order to withstand the load of atmospheric pressure (external pressure). In addition, it is necessary to provide a face plate with a high curvature in the tube axis direction. As a result, the weight of the envelope becomes considerably heavy. Moreover, when the high curvature of the face plate increases, the screen cannot be viewed clearly. In addition, the distance between the phosphor screen and the electron gun sealed within the neck increases, and the magnification of the electron lens is adversely affected.

In order to solve the problems posed in the cathode-ray tube having the above integrated phosphor screen, Jpn. Pat. Appln. KOKAI Publication No. 5-36363 discloses a cathode-ray tube (color cathode-ray tube) in which a face plate is formed to be flat, and an integrated phosphor screen formed on the inner surface of the face plate has a plurality of regions which are scanned independently of one another by electron beams emitted from a plurality of electron guns. In this cathode-ray tube, plate support means are arranged inside an envelope between a face plate and a rear plate to support the load of atmospheric pressure acting on the flat face plate and the flat rear plate opposing the face plate.

Furthermore, U.S. patent application Ser. No. 945,415, filed Sep. 16, 1992 discloses a cathode-ray tube (color cathode-ray tube) in which a plate support member for supporting the load of atmospheric pressure acting on a flat face plate, a flat rear plate opposing this face plate, and mask mounting means for supporting a shadow mask are fixed to a fixing member which is fixed in tight contact with the inner surface of the rear plate.

Such a color cathode-ray tube is manufactured in the following manner. A phosphor screen is coated on the inner surface of a face plate in advance. Plate support means and mask mounting means are fixed to a rear plate, and a shadow mask is mounted on the mask mounting means. Then, the face plate on which the phosphor screen is formed is joined to the rear plate, on which the plate support means and the shadow mask are mounted, through a side wall. Therefore, it is difficult to assemble the phosphor screen and the shadow mask in a predetermined relationship with high precision.

More specifically, the phosphor screen of the color cathode-ray tube has stripe-shaped three color phosphor layers which extend in the vertical direction in parallel with one another and are arranged in the horizontal direction. This phosphor screen is manufactured by using a master mask on which reference patterns are formed at predetermined pitches. Specifically, the pattern of the master mask are formed on a screen formation material layer coated on the inner surface of the face plate by photoprinting method. Therefore, in assembly of the above color cathode-ray tube, the phosphor screen should be accurately positioned at a predetermined position with respect to the shadow mask mounted on the rear plate via the mask mounting means, thereby positioning the face plate.

The phosphor screen must be accurately positioned in the horizontal, vertical, and rotational directions of the three stripe-like color phosphor layers with respect to the shadow mask. The required precision of this positioning is about 10% or less of the width of the three color phosphor layers, though it depends on the pitches of the three color phosphor layers. Higher precision are required particularly in the horizontal and rotational directions. If one end of the phosphor screen in the horizontal direction is defined as a reference, an offset at the other end in the horizontal direction must be 0.01 mm or less.

Still further, in the structure in which the shadow mask is mounted on the rear plate via the mask mounting means in the above manner, the phosphor screen is indirectly positioned with respect to the shadow mask via the mask mounting means, the rear plate, the side wall, and the face plate. For this reason, even if the precision of an assembly jig used in the assembly process is improved, a cumulative error further increases. Thus, it is difficult to obtain desired precision.

SUMMARY OF THE INVENTION

The present invention has been made to solve the above problems, and has its object to provide a cathode-ray tube in which a phosphor screen is coated on a flat face plate, and a shadow mask is mounted on a rear plate via a mask mounting means, and a method of manufacturing the same, wherein the shadow mask and the phosphor screen are positioned with high precision.

In order to achieve the above object, according to the present invention, there is provided a color cathode-ray tube comprising: an envelope having a substantially flat face plate, a side wall extending in a direction substantially perpendicular to a peripheral portion of the face plate, a substantially flat rear plate opposing the face plate, and a phosphor screen formed on an inner surface of the face plate; a shadow mask arranged in the envelope and having a plurality of electron beam passage holes; mask support means provided on the rear plate, for supporting the shadow mask to face the phosphor screen at a predetermined distance; and positioning means for positioning the face plate and the shadow mask with respect to the rear plate, the positioning means having a positioning portion provided at the envelope, and an engaging portion provided at the shadow mask and engaging the positioning portion.

According to the present invention, a method of manufacturing a color cathode-ray tube comprises the steps of: mounting positioning means on the rear plate; positioning the shadow mask with respect to the rear plate by using the positioning means as a reference; fixing the positioned shadow mask to mask support means; and positioning the face plate with respect to the rear plate by using the positioning means as a reference.

According to the present invention, there is provided another color cathode-ray tube comprising: an envelope having a substantially flat face plate, a side wall extending in a direction substantially perpendicular to a peripheral portion of the face plate, a substantially flat rear plate opposing the face plate, and a phosphor screen formed on an inner surface of the face plate; a shadow mask arranged in the envelope and having a plurality of electron beam passage holes; mask support means provided on the rear plate, for supporting the shadow mask to face the phosphor screen at a predetermined distance; and positioning means provided on an inner surface of the face plate, for positioning the face plate with respect to the rear plate, the phosphor screen being formed in a predetermined positional relationship with the positioning means.

When a color cathode-ray tube having the above arrangement is manufactured, positioning means is mounted on an inner surface of the face plate at a predetermined position with respect to the phosphor screen, and the face plate and the rear plate are positioned by using the positioning means as a reference.

In addition, according to the present invention, there is provided still another color cathode-ray tube comprising: an envelope having a substantially flat face plate, a side wall extending in a direction substantially perpendicular to a peripheral portion of the face plate, a substantially flat rear plate opposing the face plate, and a phosphor screen formed on an inner surface of the face plate; a shadow mask arranged in the envelope and having a plurality of electron beam passage holes; mask support means provided at the rear plate, for supporting the shadow mask to face the phosphor screen at a predetermined distance; first positioning means provided at the rear plate and engaged with the shadow mask, for positioning the shadow mask with respect to the rear plate; and second positioning means for positioning the face plate with respect to the rear plate, the second positioning means having a reference mark formed on the inner surface of the face plate in a predetermined positional relationship with the phosphor screen, and a positioning member mounted on the inner surface of the face plate at a predetermined position with respect to the reference mark.

According to the present invention, a method of manufacturing the color cathode-ray tube comprises the steps of: mounting the first positioning means on the rear plate; positioning the shadow mask with respect to the rear plate by using the first positioning means as a reference; fixing the positioned shadow mask to the mask support means; mounting the second positioning means on the inner surface of the face plate at a predetermined position with respect to the phosphor screen; and positioning the face plate to the rear plate by using the first and second positioning means as references.

As described above, if the positioning means for positioning at least the face plate among the face plate and the shadow plate is provided at the rear plate, the face plate can be positioned by using this positioning means as a reference. For this reason, the shadow mask and the phosphor screen can be accurately positioned free from cumulative errors of mounting positions of the mask mounting means, the rear plate, the side wall, the face plate, and the like in assembly of a color cathode-ray tube, thereby obtaining a color cathode-ray tube with high precision.

Moreover, as described above, the positioning means is provided at the inner surface of the face plate in a predetermined relationship with the phosphor screen, and the face plate and the rear plate are positioned by using this positioning means as a reference. With this structure, the shadow mask and the phosphor screen can be accurately positioned free from cumulative errors of mounting positions of the mask mounting means, the rear plate, the side wall, the face plate, and the like in assembly of a color cathode-ray tube, thereby obtaining a color cathode-ray tube with high precision.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 7 show a color cathode-ray tube according to the first embodiment of the present invention, in which:

FIG. 1 is a perspective view showing the structure of the color cathode-ray tube, FIG. 2 is a sectional view taken along a line II— II in FIG. 1, FIG. 3 is an exploded perspective view showing the structure of the color cathode-ray tube, FIG. 4 is an enlarged sectional view showing an abutting portion of the distal end of a plate support member and a phosphor screen, FIG. 5 is an enlarged sectional view showing a part of FIG. 2, FIG. 6 is an exploded perspective view showing an engaging portion of a shadow mask and a positioning post, and FIG. 7 is a perspective view showing a mounted state of a positioning pin;

FIGS. 8 to 11 show a color cathode-ray tube according to the second embodiment of the present invention, in which:

FIG. 8 is an exploded perspective view showing the structure of the color cathode-ray tube, FIG. 9 is a sectional view of the color cathode-ray tube, FIG. 10 is a perspective view showing a mounting structure of a positioning pin, and FIG. 11 is a perspective view for explaining a method of mounting a positioning pin;

DETAILED DESCRIPTION OF THE PREFERRED EMBODIMENTS

Embodiments of the present invention will be described in detail with reference to the accompanying drawings.

Figure 1:
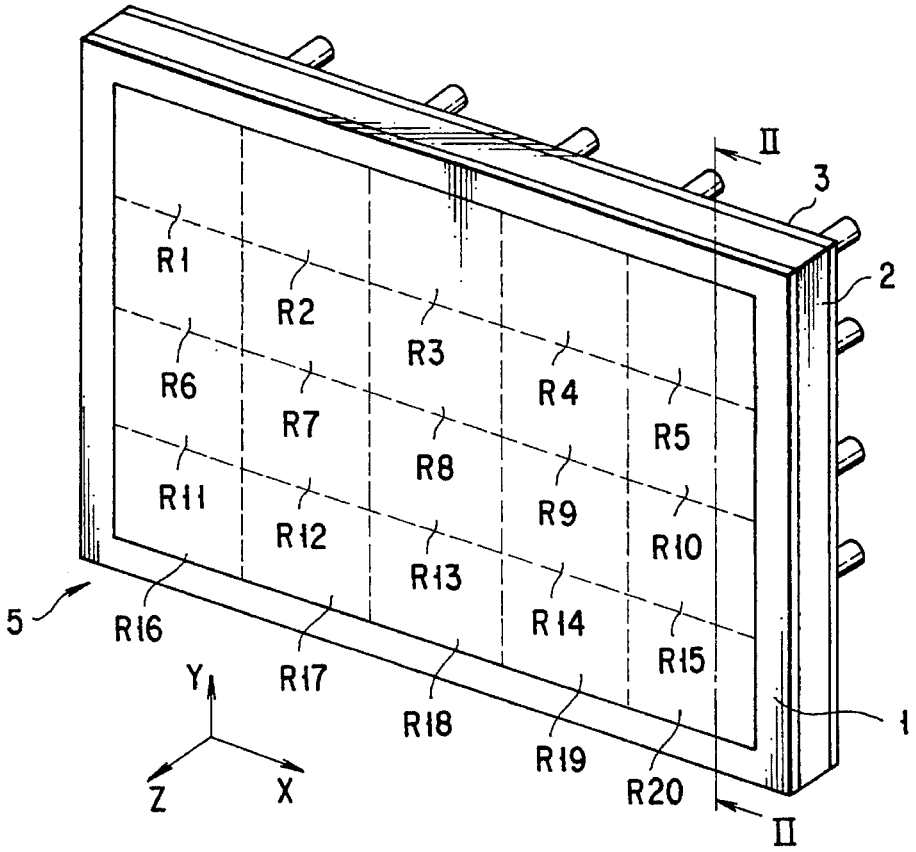
Figure 2:
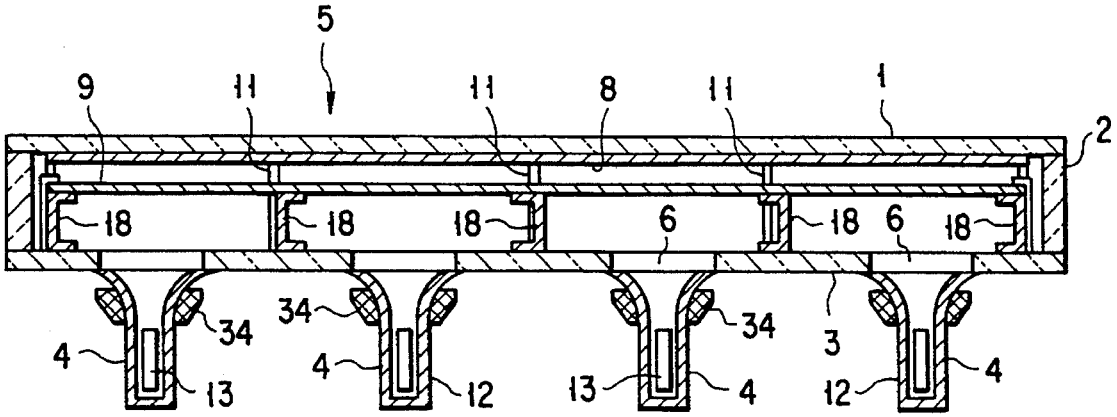
Figure 3:
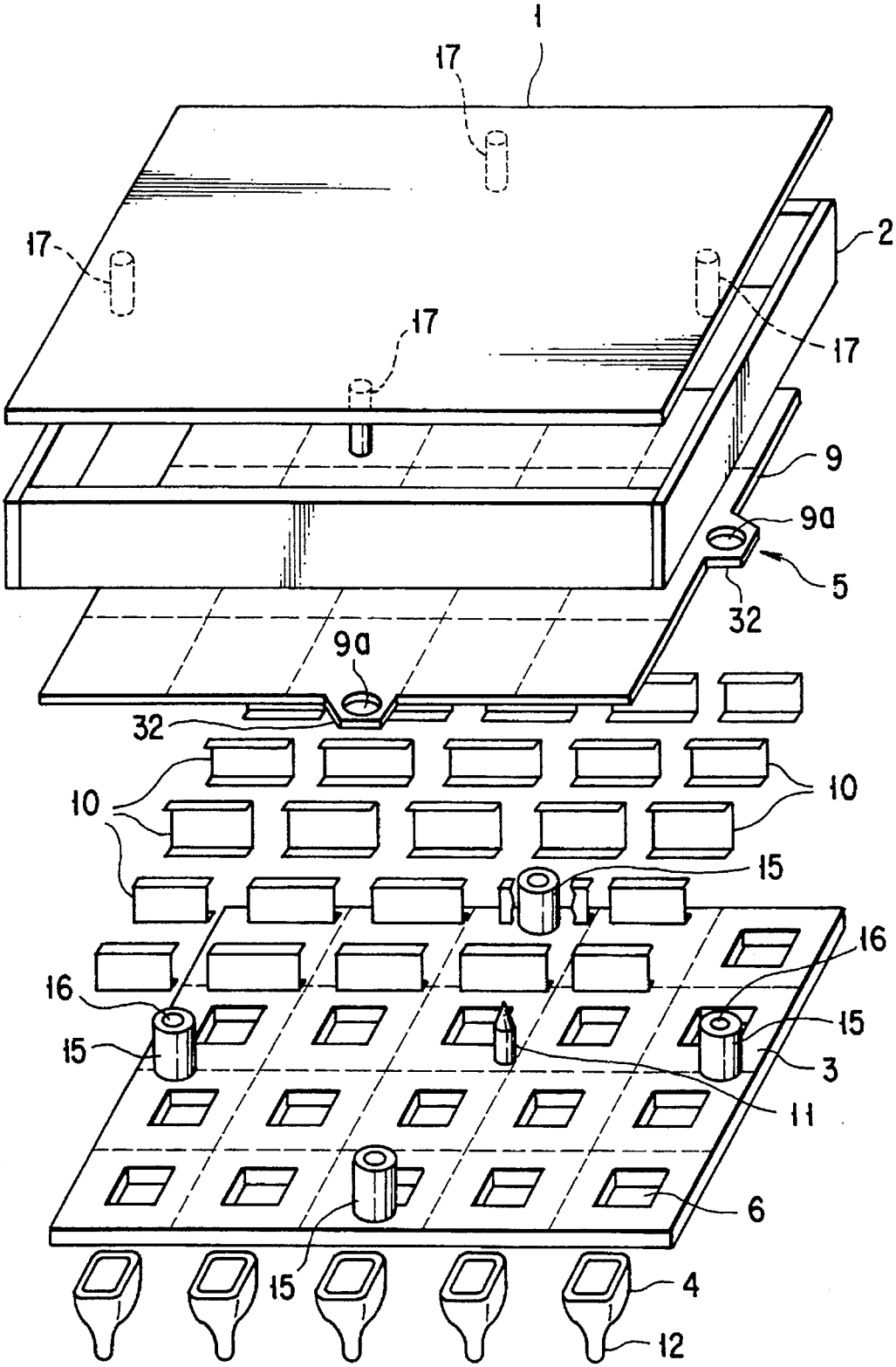

FIGS. 1 to 7 show the arrangement of a color cathode-ray tube according to a first embodiment of the present invention. As shown in FIGS. 1 to 3, this color cathode-ray tube has a vacuum envelope 5 which comprises a substantially rectangular, flat glass face plate 1, a frame-like side wall 2, a substantially rectangular, flat glass rear plate 3, and a plurality of funnels 4. The side wall 2 is joined to the edge portion of the face plate 1 to extend in a direction substantially perpendicular to the face plate 1. The rear plate 3 is joined to the face plate 1 and opposite to the face plate 1 in parallel thereto via the side wall 2. The funnels 4 are jointed to the rear plate 3. A plurality of (e.g., 20) rectangular openings 6 are formed in the rear plate 3. These openings are arranged in the form of a matrix, e.g., five (columns)×four (rows). The funnels 4 are fixed to the outer surface of the rear plate 3 to surround the corresponding openings 6, respectively. A total of 20 funnels 4 are arranged in the form of a matrix of five funnels in the horizontal direction (X direction)×four funnels in the vertical direction (Y direction).

Figure 4:
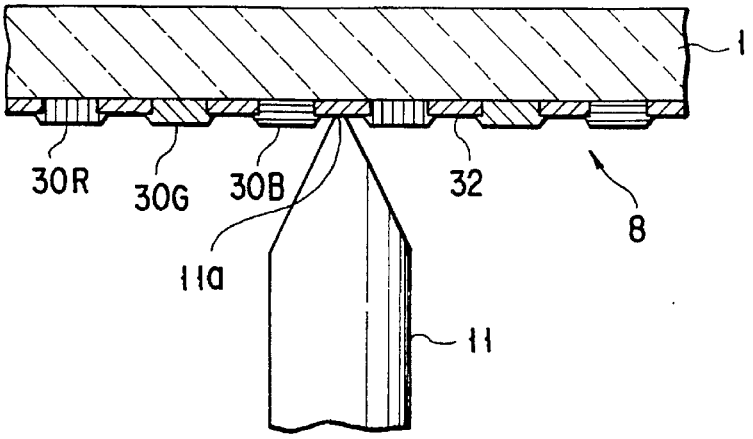

As shown in FIG. 4, an integrated phosphor screen 8 is formed on the inner surface of the face plate 1. The phosphor screen 8 has stripe-shaped three color phosphor layers 30B, 30G, and 30R which emit blue, green, and red light, and black stripes 32 arranged between these three color phosphor layers. All stripes extend in the vertical direction.

As shown in FIGS. 2 to 5, a flat shadow mask 9 is arranged in the envelope 5 to oppose the phosphor screen 8. The shadow mask 9 has a plurality of effective portions corresponding to a plurality of regions R1 to R20 of the phosphor screen 8 which are scanned independently of one another, as will be described later. A large number of apertures (electron beam passage apertures) 9*b* for passing electron beams are formed in each effective portion. This shadow mask 9 is mounted on a large number of mask support members 10 having a substantially U-shaped cross-section. The mask support members are fixed to the inner surface of the rear plate 3 and extend in the horizontal direction so as to interpose respective openings 6 of the rear plate 3 therebetween in the vertical direction (Y direction).

A plurality of columnar plate support members 11 are arranged between the face plate 1 and the rear plate 3 and support the flat face plate 1 and rear plate 3 against the load of atmospheric pressure acting on to the vacuum envelope 5. The proximal end of each plate support member 11 is fixed to the inner surface of the rear plate 3 in the same manner as the mask support member 10. As shown in FIG. 4, the distal end portion of each plate support member 11 has a wedge-like shape and is in contact with a corresponding black stripe 32 of the phosphor screen 8. An electron gun 13 for emitting electron beams toward the phosphor screen 8 is arranged in each of necks 12 of the funnels 4.

Figure 5:
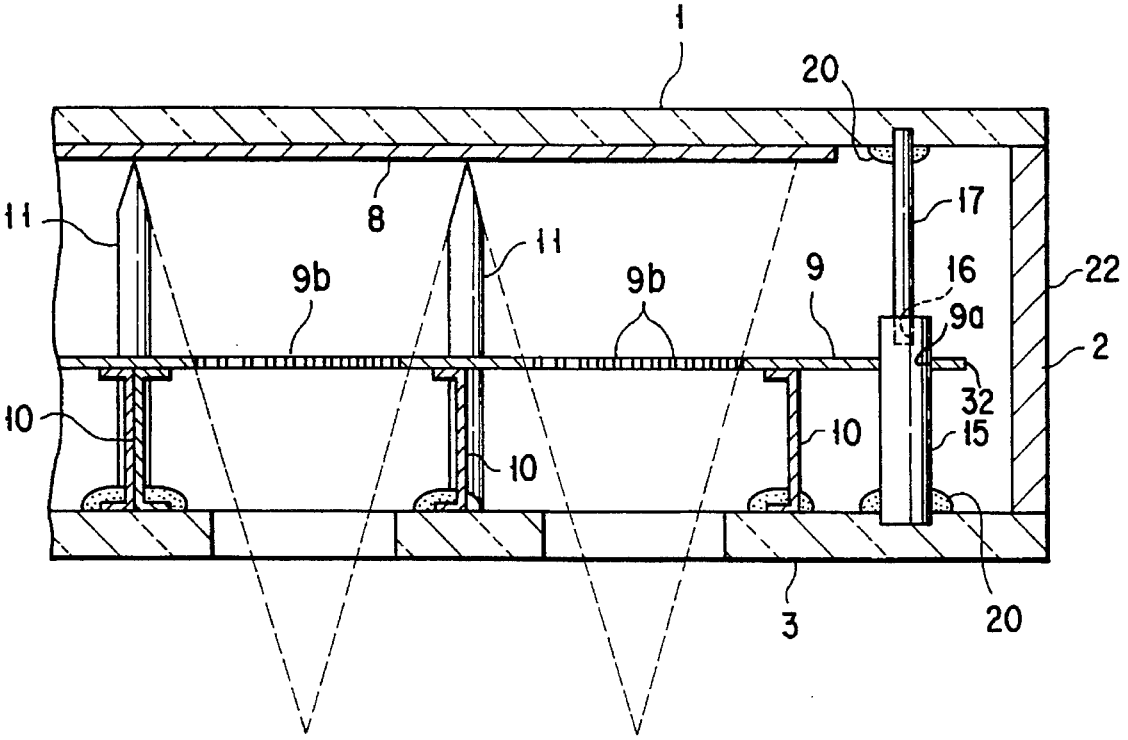

In the color cathode-ray tube, as shown in FIGS. 3 and 5, positioning posts 15 are fixed to the peripheral portions of the inner surface of the rear plate 3 which are adjacent to the central portions of respective edges of the rear plate 3, and which extend toward the face plate 1 along the side wall 2. Each post 15 is formed into a columnar shape, having a circular positioning recess 16 formed on an extended end of each post 15 functioning as a positioning portion. Positioning pins 17 are fixed to the peripheral portions of the inner surface of the face plate 1, adjacent to the central portions of respective edges of the face plate 1 and corresponding to the positions of the positioning posts 15. Each pin 17 extends toward the rear plate 3. Extended ends of the positioning pins 17 are fit in the positioning recesses 16 of the corresponding positioning posts 15.

The shadow mask 9 has projections 34, each of which extending outwardly from the center of each side edge. A setting opening 9*a* is formed in each projection 34 as a engaging portion. Each setting opening 9*a* has a diameter substantially equal to that of the positioning post 15. The positioning posts 15 are inserted into the corresponding setting openings 9*a*.

Therefore, the face plate 1 and the shadow mask 9 are positioned at predetermined positions with respect to the rear plate 3 by means of the positioning posts 15, the positioning pins 17 and the setting openings 9*a*. The shadow mask 9 is positioned with respect to the face plate 1 in the same manner. In this way, the positioning posts 15, pins 17, and the setting openings 9*a* constitute positioning means of the present invention.

In order to increase the respective fixing strengths of the positioning posts 15 and the positioning pins 17 with respect to the rear plate 3, recesses each having a depth of about 2 mm are formed in the rear plate 3 and the face plate 1. The proximal end portions of the posts 15 and the pins 17 are fitted in the corresponding recesses and are bonded to the rear plate by means of frit glass 20, thereby fixing the posts and pins to the rear plate.

In this color cathode-ray tube, electron beams emitted from each of the electron guns 13 are deflected in the vertical and horizontal directions by a deflection yoke 34 mounted on the outer surface of each funnel 4. With this operation, a total of 20 regions R1 to R20 (five regions in each row; four regions in each column) of the phosphor screen 8 are individually scanned by electron beams via the shadow mask 9. Rasters drawn on the phosphor screen 8 by this divisional scanning are connected to each other by signals applied to the electron guns 13 and the deflection yokes. As a result, a large raster free from discontinuity is reproduced on the entire phosphor screen 8.

A method of manufacturing the above-mentioned color cathode-ray tube will be described.

Figure 6:
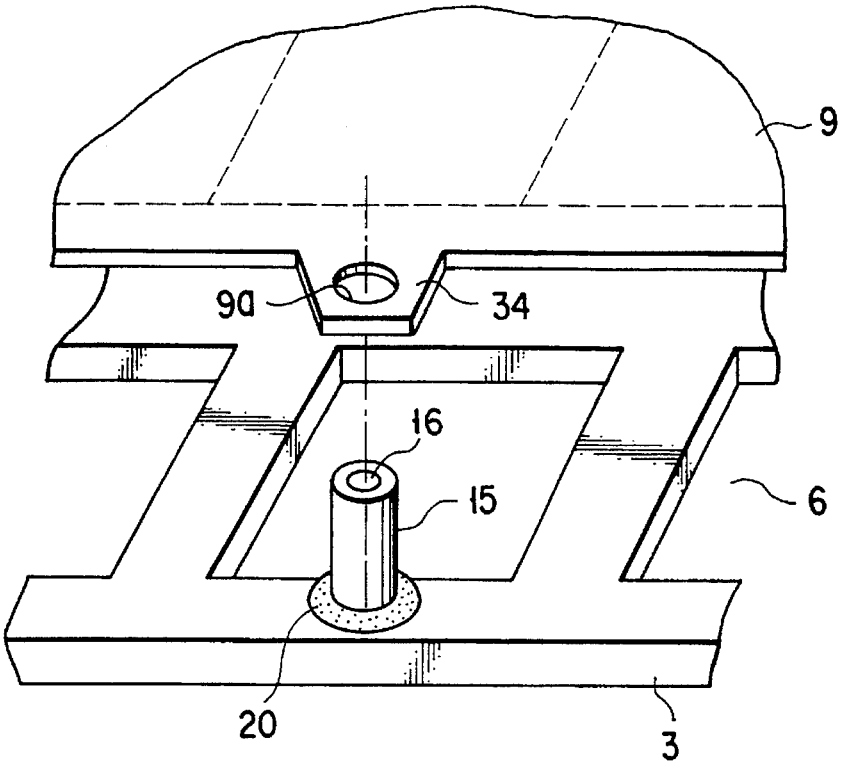

First, the mask support members 10 and plate support members 11 are arranged at predetermined positions on the inner surface of the rear plate 3 by using a fixing jig or the like. As shown in FIG. 6, the proximal ends of the positioning posts 15 are fitted in the recesses formed at predetermined positions on the inner surface of the rear plate 3. Thereafter, the mask support members 10, plate support members 11, and posts 15 are fixed to the rear plate 3, by coating frit glass 20 on these members and burning the frit glass. In this case, the frit glass 20 is coated and burned while the mask support members 10 and the plate support members 11 are pressurized to be in tight contact with the rear plate 3 so as to prevent the frit glass from entering between these members 10 and 11 and the inner surface of the rear plate 3. This is because when the frit glass enters between the mask support members 10 and the plate support members 11 and the inner surface of the rear plate 3, the heights of these members 10 and 11 undesirably change.

Thereafter, the shadow mask 9 is welded/fixed to the plurality of the mask support members 10 on the rear plate 3 by using the positioning posts 15 as references while a tensile force being applied to the shadow mask 9. In this case, the positioning posts 15 are passed through the corresponding setting openings 9*a* formed on the shadow mask 9 as engaging portions, thus positioning the shadow mask 9 with respect to the positioning posts 15. The setting openings 9*a* are formed at the same time when the electron beam passage apertures 9*b* of the shadow mask 9 are to be formed by photoetching.

Figure 7:
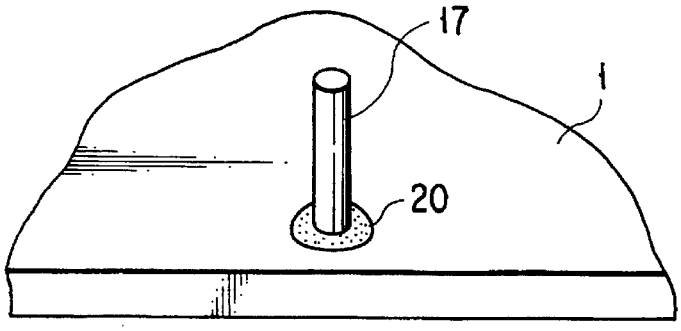

On the other hand, as shown in FIG. 7, the positioning pins 17 are fitted in the recesses formed in the inner surface of the face plate 1 at predetermined positions, by using a fixing jig or the like. Frit glass 20 is then coated on the resultant structures and burned, thus fixing the pins 17 to the face plate 1. The phosphor screen 8 constituted by stripe-shaped three color phosphor layers and black stripes is formed on the inner surface of the face plate 1 by using these pins 17 as references by a photoprinting method.

In addition, electron guns 13 are sealed within the necks 12 of the plurality of the funnels 4, respectively.

As shown in FIG. 5, the rear plate 3 to which the mask support members 10, the plate support members 11, and the positioning posts 15 are fixed, a plurality of side wall pieces 22 constituting the side wall 2, the face plate 1 having the phosphor screen 8, and the plurality of funnels 4 having the electron guns 13 sealed therein are positioned in a predetermined relationship by using an assembly jig. These components are then integrally jointed by means of frit glass. In this case, particularly, positioning of the face plate 1 is performed by fitting the positioning pins 17 fixed to the face plate 1 to the positioning recesses 16 at the distal ends of the positioning posts 15 fixed to the rear plate 3. Thereafter, the integrally assembled envelope 5 obtained in the above manner is evacuated. With this process, a color cathode-ray tube is manufactured.

According to the color cathode-ray tube having the above arrangement, the positioning posts 15 are fixed to the rear plate 3 in the above manner, and the shadow mask 9 is welded to the mask support members 10 fixed to the rear plate 3 by using the positioning posts 15 as references. On the other hand, the positioning pins 17 which engage the positioning posts 15 mounted on the rear plate 3 are fixed to the face plate 1, and the phosphor screen 8 is formed on the inner surface of the face plate 1 by using the positioning pins 17 as references. The face plate 1 on which the phosphor screen 8 is assembled with the rear plate 3 by fitting the positioning pins 17 in the positioning posts 15. For this reason, the shadow mask 9 and the phosphor screen 8 are positioned by using the positioning posts 15 as references. Thus, as compared with conventional positioning which is performed via mask support members, a rear plate, a side wall, a face plate, and the like, cumulative errors can be greatly reduced, and a shadow mask and a phosphor screen can be accurately positioned. Consequently, a color cathode-ray tube with high precision can be manufactured.

FIGS. 8 to 11 show the arrangement of a color cathode-ray tube according to a second embodiment of the present invention. The basic arrangement of the second embodiment is the same as in the first embodiment. The same reference numerals as in the first embodiment denote the same parts in the second embodiment, and a detailed description thereof will be omitted.

In the second embodiment, positioning means for positioning a face plate 1 and a rear plate 3 in a predetermined relationship in assembly of a color cathode-ray tube has four positioning posts 15 and four positioning pins 17. The positioning posts 15 are fixed to the rear plate 3. In order to increase the fixing strength of the positioning posts 15 with respect to the rear plate 3, recesses each having a depth of about 2 mm are formed in the rear plate 3, the proximal end portions of the positioning posts 15 are fitted in the recesses, and the posts 15 are fixed by means of frit glass coated therearound. A positioning recesses 16 is formed at the distal end of each positioning post 15.

Figure 8:
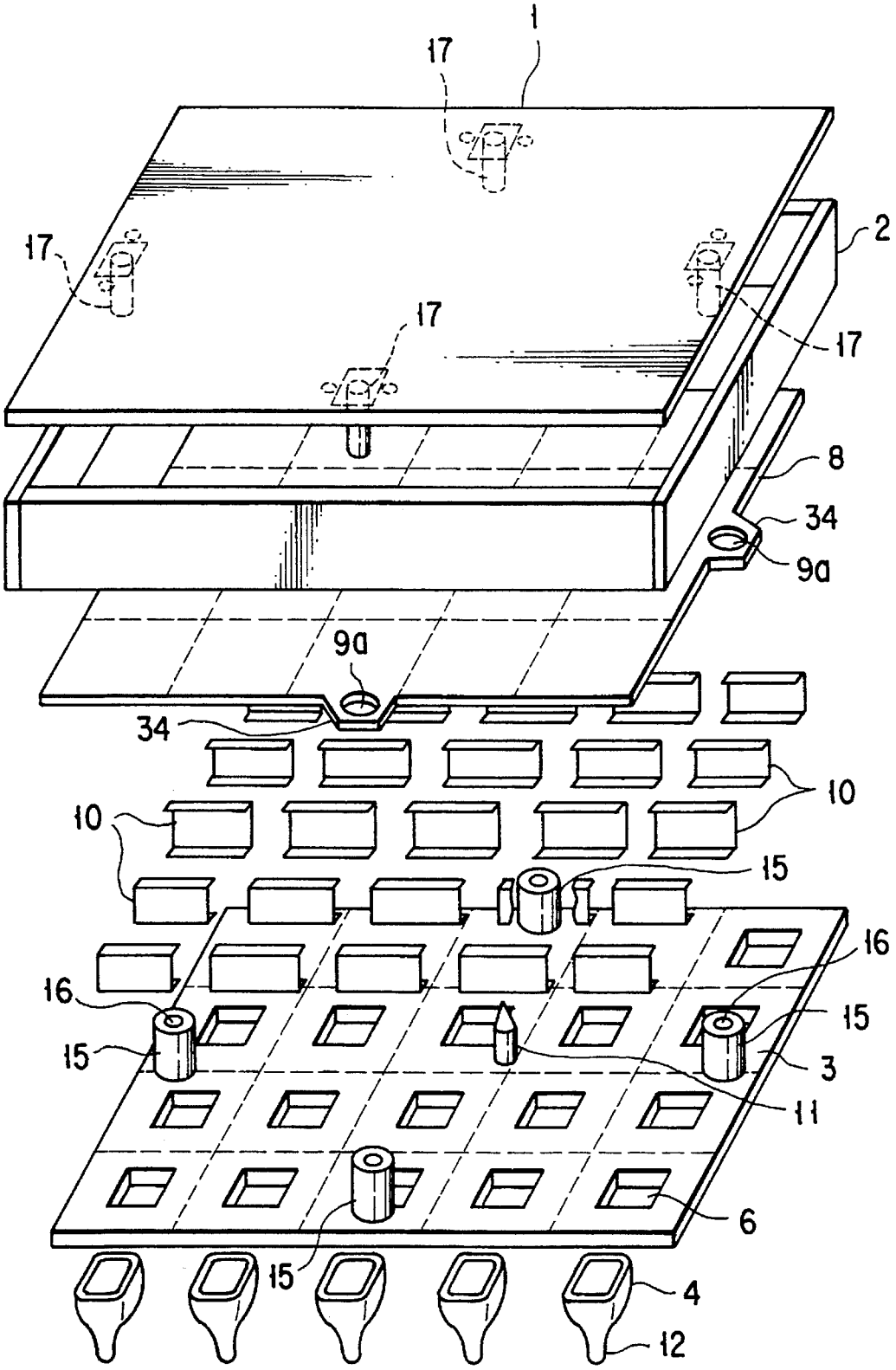
Figure 9:
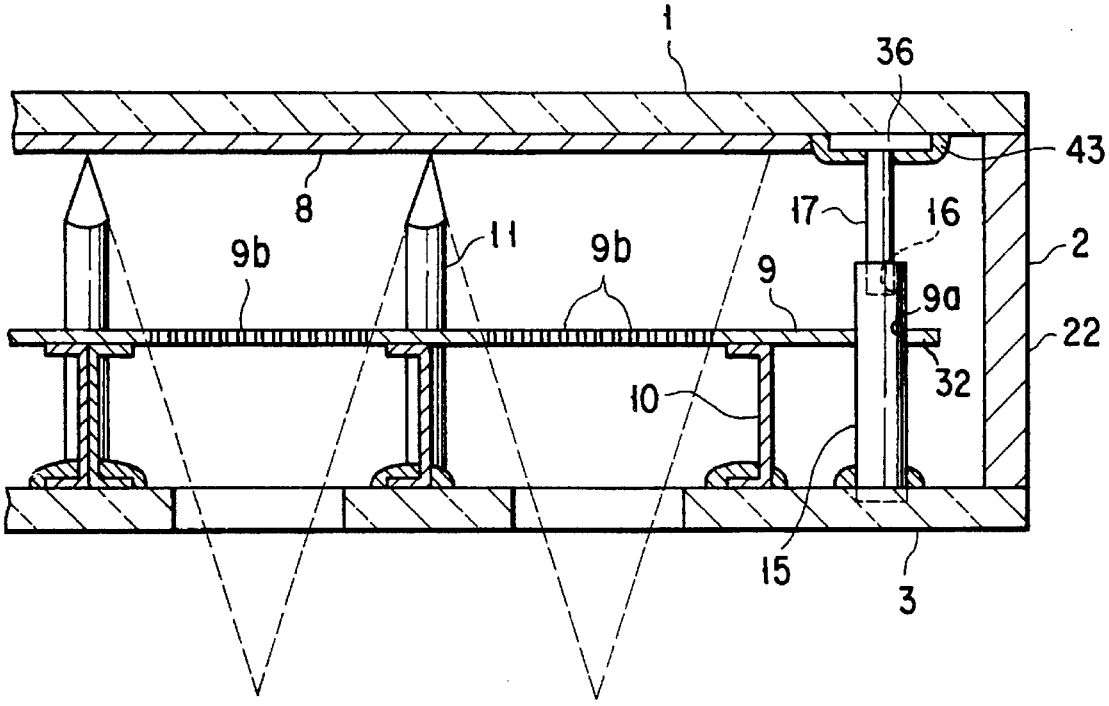
Figure 10:
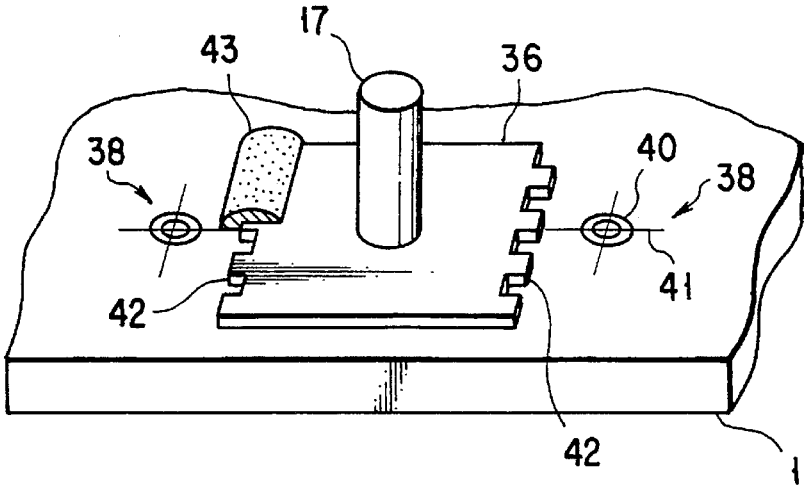

As shown in FIGS. 8 to 10, each positioning pin 17 is fixed on a fixing member 36 which is fixed to the inner surface of the face plate 1. More specifically, a pair of reference marks 38 are formed at those peripheral portions of the inner surface of the face plate 1 which are adjacent to the center of each side of the face plate in a predetermined positional relationship with a phosphor screen 8. Each reference mark 38 is constituted by a pair of 2- and 1-mm diameter concentric circles 40 each having a line width of 0.1 mm, and cross patterns 41 passing through the centers of these concentric circles 40. Each pair of the reference marks 38 are provided at a predetermined interval along a corresponding side of the face plate 1.

Each fixing member 36 is fixed between the pair of the corresponding reference marks 38 on the inner surface of the face plate 1 by using these reference marks as references. Each fixing member 36 is formed into a substantially rectangular shape. Recess/projection portions 42 as tooth-shaped corrugations are formed on the two edges of each fixing member 36 to increase bonding strength between the fixing member 36 and the face plate 1. The fixing members 36 are joined to the face plate 1 by means of frit glass 43 coated, in a swelled state, on the peripheral portions of the fixing members 36 on which the recess/projection portions 42 are formed. The distal end of each positioning pin 17 fixed to each fixing member 36 is fitted in the positioning recess 16 of the corresponding positioning post 15.

A method of manufacturing a color cathode-ray tube having the above arrangement will be described.

In the same manner as in the first embodiment, mask support members 10 and plate support members 11 are arranged and fixed to predetermined positions on the inner surface of the rear plate 3 by using a fixing jig or the like. On the other hand, a phosphor screen 8 comprising stripe-shaped color phosphor layers and black stripes is formed on the inner surface of the face plate 1 by using a master mask by the photoprinting method. The master mask has stripe-like patterns, formed in parallel at predetermined pitches, for forming the phosphor screen 8, and reference patterns for forming the reference marks 38 which are used for fixing the fixing members 36 and the positioning pins 17. When the black stripes are to be formed, the reference marks 38 are also formed.

Subsequently, as shown in FIG. 10, after the fixing members 36 are arranged between the reference marks 38 by using the respective pairs of the reference marks 38 as references, frit glass 43 is coated on the peripheral portions of the fixing members and burned to fix the fixing members 36 to the inner surface of the face plate 1. The frit glass 43 is coated and burned while the fixing members are pressurized against the face plate so as prevent the frit glass from entering between the fixing members 36 and the face plate 1. In this case, since the frit glass is burned at 450° C., the phosphor screen 8 is also burned at the burning of the frit glass, thus decomposing and removing an organic binder or the like contained in the phosphor layers or the like.

Figure 11:
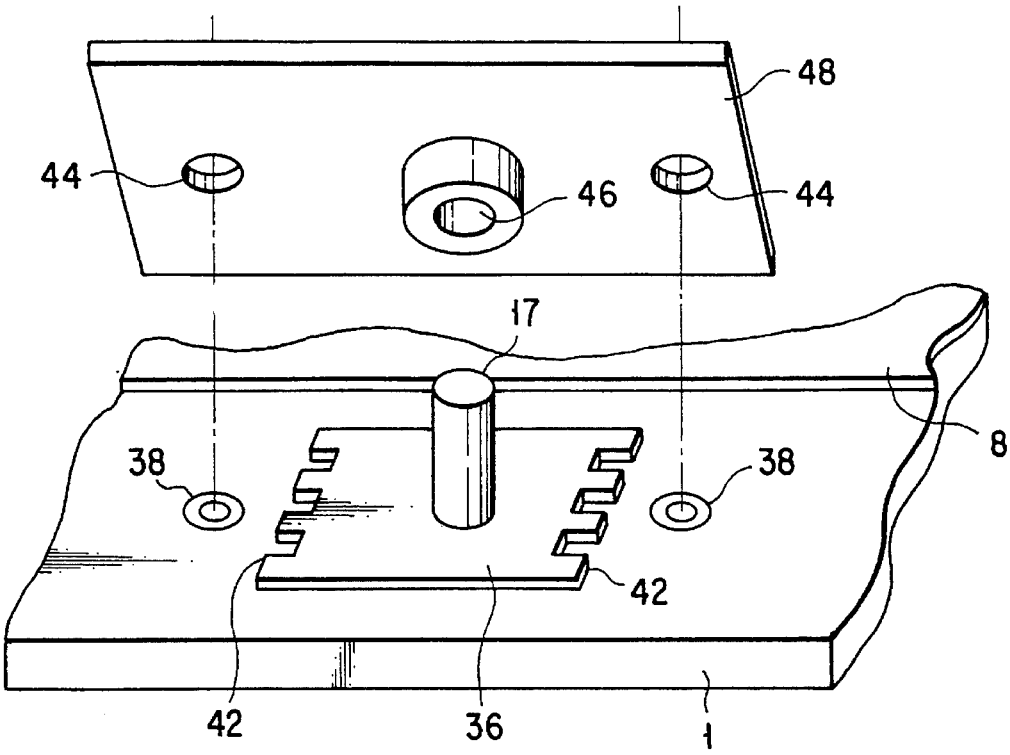

Subsequently, as shown in FIG. 11, the positioning pins 17 are fixed to the respective fixing members 36 using setting jigs 48. Each setting jig 48 has a pair of setting openings 44 having the same distance and diameter as those of the pair of the reference marks 38, and a recess 46 at the center between the pair of the setting openings 44. The distal end of the positioning pin 17 is to be fitted in the recess 46. Specifically, the positioning pin 17 is arranged on the fixing member 36 while the distal end of the pin 17 is fitted and held in the recess 46 of the setting jig 48, and the pair of the setting openings 44 of the setting jig 48 respectively aligned with the pair of reference marks 38 formed on the inner surface of the face plate 1. Alignment of the pair of setting openings 44 and the pair of the reference marks 38 is performed by, e.g., moving the setting jig 48 by a precision stage, and observing the reference marks 38 enlarged with a microscope through the setting openings 44.

With this process, after the setting openings 44 of the setting jigs 48 aligned with the reference marks 38, the proximal ends of the positioning pins 17 which are fitted and held in the recess portions 46 of the setting jigs 48 are welded to the fixing members 36 by means of laser welding. Thereafter, the setting jigs 48 are removed.

Electron guns 13 are sealed within the necks 12 of the plurality of funnels 14, respectively.

As shown in FIG. 9, the rear plate 3 to which the mask support members 10, the plate support members 11, and the positioning posts 15 are fixed, a plurality of side wall pieces 22 constituting the side wall 2, the face plate 1 which has the phosphor screen 8 and on which the positioning pins 17 are mounted, and the funnels 4 having the electron guns 13 sealed therein are positioned in a predetermined relationship by using an assembly jig. These components are then integrally jointed by means of frit glass. In this case, particularly, positioning of the face plate 1 is performed by fitting the positioning pins 17 on the face plate 1 to the positioning recess portions 16 at the distal ends of the positioning posts 15 which are fixed to the rear plate 3. Thereafter, the integrally joined envelope 5 obtained in the above manner is evacuated. With these processes, a color cathode-ray tube is manufactured.

According to the second embodiment described above, the positioning posts 15 are fixed to the rear plate 3 in the above manner, and the shadow mask 9 is welded to the mask support members 10 fixed to the rear plate 3, by using the positioning posts 15 as references. On the other hand, the reference marks 38 are formed on the face plate 1 in a predetermined positional relationship with the phosphor screen 8, and the positioning pins 17 which engage with the positioning posts 15 are mounted on the face plate 1 by using the reference marks 38 as references. The positioning pins 17 and the positioning posts 15 are engaged with each other to assemble and position the face plate 1 and the rear plate 3. For this reason, the shadow mask 9 and the phosphor screen 8 are positioned by using the positioning posts 15 as references. Thus, as compared with conventional positioning of the shadow mask 9 and the phosphor screen 8 which is performed via mask support members, a rear plate, a side wall, a face plate, and the like, cumulative errors can be greatly reduced, and a shadow mask and a phosphor screen can be accurately positioned. Consequently, a color cathode-ray tube with high precision can be manufactured.

Furthermore, according to the second embodiment, the reference marks 38 are formed at the same time when the phosphor screen 8 is to be formed on the inner surface of the face plate 1. After formation of the phosphor screen 8, the positioning pins 17 are fixed to the face plate 1 by using the reference marks 38 as references. For this reason, the positioning pins 17 do not become obstacles in formation of the phosphor screen 8, or the positioning pins 17 are not damaged.

The above second embodiment has the arrangement in which the positioning pins 17 are positioned and fixed to the fixing members 36 by using the specific setting jigs 48. By using the following structure, however, the positioning pins 17 may be fixed without using the setting jigs.

Figure 12:
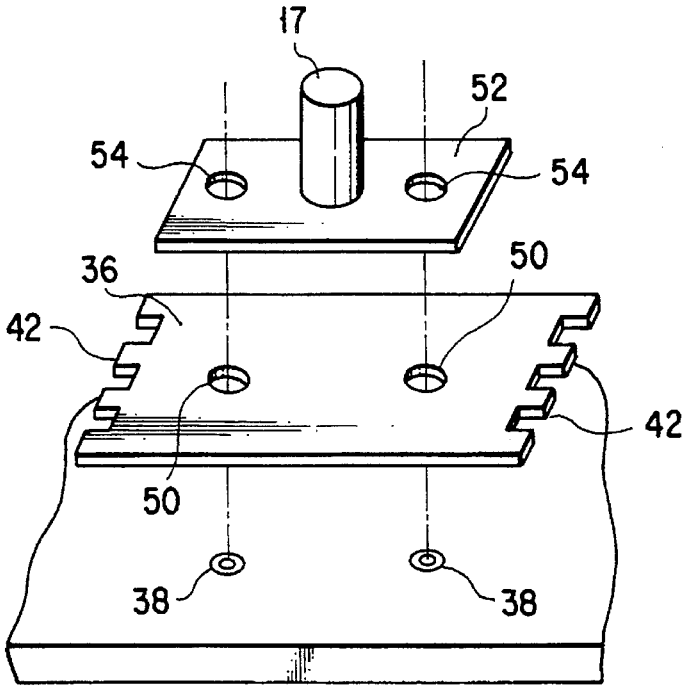
FIG. 12 is a perspective view showing a mounting structure of a positioning pin according to still another embodiment.

More specifically, as shown in FIG. 12, according to still another embodiment, each fixing member 36 has a pair of circular openings 50 each having a diameter slightly larger than that of a concentric circle 40 of each pair of reference marks 38 formed on the inner surface of a face plate 1. The pair of openings 50 are provided at a predetermined interval equal to that between the pair of the reference marks 38. Each fixing member 36 is fixed to the inner surface of the face plate 1 by means of frit glass coated on the peripheral portion of the fixing member 36 while the pair of the circular openings 50 are aligned with the pair of the reference marks 38. The reason why the diameter of each circular opening 50 is larger than that of each concentric circle 40 of the reference mark 38 will be described. That is, when the fixing members 36 are fixed by means of frit glass, even if the openings 50 are slightly offset from the reference marks 38, the reference marks are not shielded with the fixing members.

On the other hand, each of positioning pins 17 constituting positioning means is fixed to a rectangular support plate 52 in advance. Each support plate 52 has a pair of circular openings 54 which are formed to have the same interval and size as those of the pair of the reference marks 38. The proximal end of the pin 17 is fixed to the support plate 52 at a middle position between the circular openings 54. The support plate 52 is welded/fixed to the fixing member 36 while the pair of the circular openings 54 are aligned with the pair of the reference marks 38, thus fixing the positioning pin 17 at a predetermined position on the inner surface of the face plate 1.

The positioning pins 17 fixed in the above manner are engaged with positioning recesses 16 of positioning posts 15 fixed to a rear plate 3, thus positioning the face plate and the rear plate with each other.

According to the above arrangement, when the positioning pins 17 are mounted on the face plate 1, the same effect as that in the second embodiment can be obtained. In addition, upon mounting the positioning pins 17, since a specific setting jig is not required, assembly errors caused by a setting jig can be reduced.

The present invention is not limited to the above embodiments, and various changes and modifications are deemed to lie within the spirit and scope of the invention.

Figure 13:
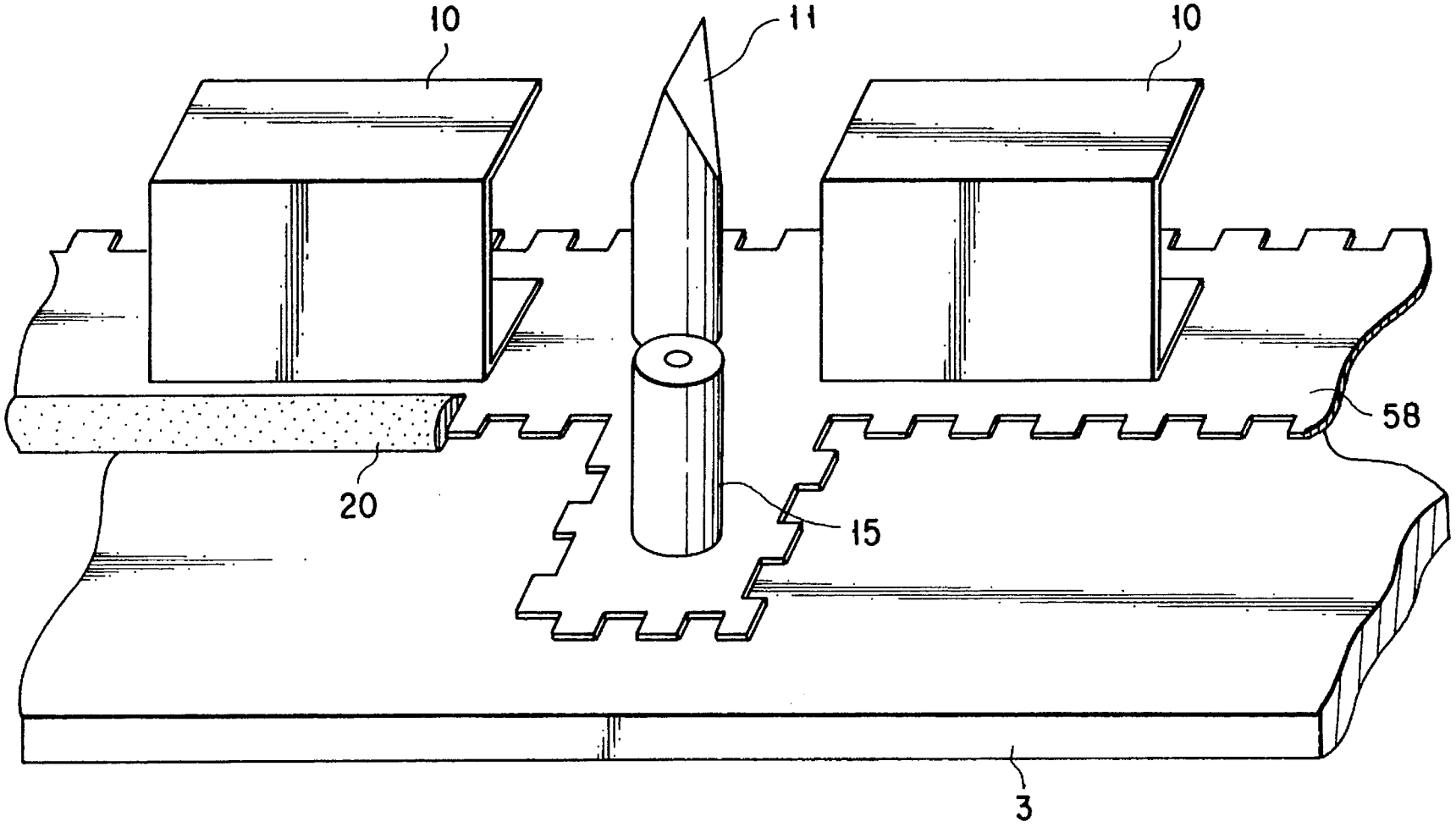
FIG. 13 is a perspective view showing a mounting structure of a positioning pin, mask support members, and a plate support member according to still another embodiment.

For example, in each embodiment described above, the mask support members, plate support members, and the positioning posts are directly fixed to the rear plate 3 by means of frit glass. As shown in FIG. 13, however, plate-like fixing members 58 made of a metal having a thermal expansion coefficient approximating to that of the rear plate 3 may be fixed to the rear plate 3 by means of a bonding agent such as frit glass 20 in advance. The mask support members 10, the plate support members 11, and the positioning posts 15 may be fixed to the fixing members 58. With such a structure, for example, each member can be fixed to the fixing member 58 by laser welding capable of welding at room temperature. Therefore, precision of the fixed position of each member can be improved. In addition, since each member is not directly fixed to the glass rear plate 3, each member need not be made of a material having a thermal expansion coefficient approximately to that of the rear plate 3, and a degree of freedom of selection of materials increases.

In addition, according to the above embodiments, the shadow mask 9 and the phosphor screen 8 can be arranged and fixed in a predetermined positional relationship with high precision by using the positioning posts and the positioning pins. However, it is difficult to arrange, with high precision, the plate support members 11 and the phosphor screen 8 in a predetermined positional relationship, i.e., such that the distal ends of the plate support members abut against the black stripes. In the structure in which the plate support members 11 are directly adhered to the rear plate 3 by means of the frit glass, various offsets occur in a thermal treatment for burning of the frit glass. As shown in FIG. 13, however, a plurality of plate support members and positioning posts are fixed to the fixing members 58 which are previously fixed to the rear plate 3 by means of frit glass. With this structure, the plurality of plate support members and positioning posts can be mounted on predetermined positions by using a common assembly jig at room temperature. For this reason, the arrangement precision (positional relationship) of the plate support members and the positioning posts can be greatly improved to the same degree as the precision of the assembly jigs. Therefore, all the plate support members, the shadow mask, and the phosphor screen are positioned by using the positioning posts as references, thus obtaining extremely high assembly precision.

Figure 14:
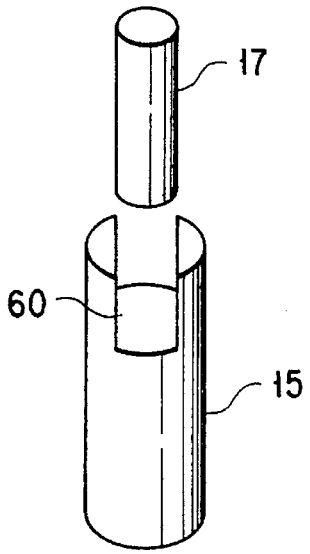
FIG. 14 is a perspective view showing a modification of a positioning post.
Figure 15:
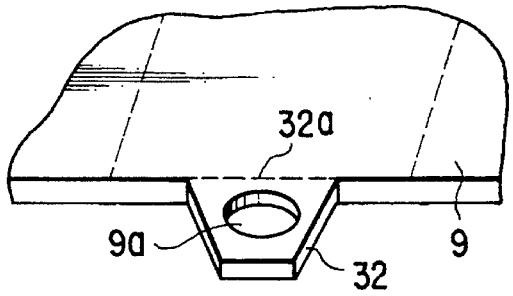
FIG. 15 is a perspective view showing a modification of an engaging portion of a shadow mask.
Figure 16A:
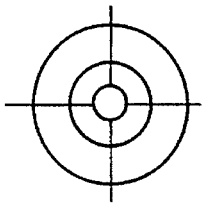
FIGS. 16A to 16D are schematic plan views showing different modifications of a reference mark, respectively.
Figure 16B:
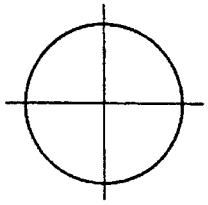
Figure 16C:
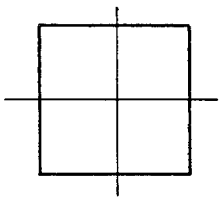
Figure 16D:
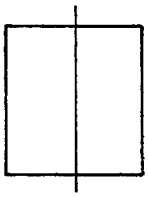

In the above embodiments, the positioning portions constituted by the circular positioning recesses 16 are formed on the positioning posts 15 on the rear plate 3 side, and the positioning pins 17 on the face plate 1 side are fitted in the positioning portions. As shown in FIG. 14, each positioning portion may be constituted by a groove 60 open to the distal end and peripheral surface of the positioning post, and the positioning pins 17 at the face plate side may be engaged with these grooves. With this structure, contact areas between the positioning posts 15 and the positioning pins 17 can be decreased and the positioning posts 15 and the positioning pins 17 can be smoothly engaged with each other.

Furthermore, when the phosphor screen 8 formed on the inner surface of the face plate 1 has a stripe-like shape, the grooves 60 formed in the positioning posts 15 are made to extend in a direction parallel to the longitudinal direction of the stripe, i.e., the vertical direction (Y direction), thus defining the position of the face plate in a direction perpendicular to the longitudinal direction of the stripe with respect to the rear plate. Consequently, a positional relationship between the shadow mask and the face plate can be accurately set in an alignment direction of each phosphor color. When a positional relationship between the rear plate and the face plate is defined also in the longitudinal direction of the stripe, another positioning members having grooves extending a direction perpendicular to the longitudinal direction of the stripe may be added on the rear plate side.

In the above embodiments, the positioning portions constituted by the recesses are formed on the positioning posts on the rear plate side, and the positioning pins on the face plate side are fitted in the recesses. In contrast to this, positioning portions constituted by recesses may be formed on the positioning pins, and the positioning posts may be fitted in the recesses.

Moreover, in the above embodiments, each positioning post and each positioning pin are provided at the central portions of the peripheral portions at the respective edges of the face plate and the rear plate. However, the positions and numbers of the positioning posts and positioning pins are not limited to the above embodiments, and they can be changed as needed. For example, these posts and pins may be arranged on the outer surface of the vacuum envelope.

According to the method of positioning the shadow mask in the above-mentioned embodiments, the shadow mask is positioned by engaging the positioning posts fixed to the rear plate with the setting openings formed in the shadow mask at the same time when the electron beam passage apertures are to be formed. However, after the shadow mask is welded to the mask support members, the shadow mask and the positioning posts need not be engaged with each other. In some cases, this engagement becomes an obstacle to thermal expansion of the shadow mask, thereby causing deformation of the shadow mask. For this reason, after the shadow mask is fixed to the mask support members, the projections 32 with the setting openings **9*a*** are cut off from the effective portion of the shadow mask which has the electron beam passage apertures, thus disengaging the shadow mask from the positioning posts.

As one preferable disengaging method, as shown in FIG. 14, when the electron beam passage apertures are formed in the shadow mask by using a photoetching method, a half-etched portion (separation portion) **32*a* is formed in the boundary between the effective portion of the shadow mask 9 and each projection (engaging portion) having the setting opening 9*a*. In this case, the positioning posts are engaged with the setting openings 9*a* to position the shadow mask 9, and the shadow mask is welded/fixed to the mask support members. Thereafter, the projection portions 32 can be easily cut off from the shadow mask at the half-etched portions 32*a***.

In addition, each reference mark 38 used for fixing the positioning portion to the face plate, and each setting opening provided at the fixing member or the support member have circular shapes, respectively. However, the mark and the opening may have other shapes, respectively. For example, as shown in FIGS. 16A to 16D, the reference mark 38 may be triple concentric circles, a single circle, a combination of a rectangular frame and a cross pattern, and a combination of a rectangular frame and a line.

Figure 17:
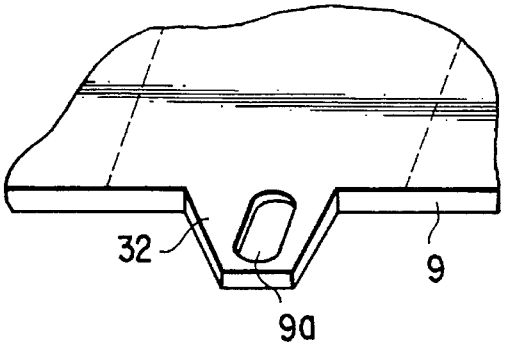
FIG. 17 is a perspective view showing a modification of a setting opening of a shadow mask.

Moreover, as shown in FIG. 17, each setting opening 9*a* as the engaging portion formed in the shadow mask may be formed into an elongated opening, or may be constituted by a notched portion. This engaging portion is provided at the projection 32 extending from the side edge of the shadow mask, but the arrangement is not limited to this. The engaging portion may be formed on the shadow mask in a region outside the effective region in which the electron beam passage apertures 9*b* are formed.

Still further, in each embodiment described above, the rear plate, the side wall, the face plate, and the funnels are integrally joined to each other to constitute the envelope. A color cathode-ray tube according to each embodiment can be manufactured by another methods. For example, a rear plate provided with plate positioning members, positioning posts, and mask support members to which the shadow mask is fixed; a plurality of side wall pieces constituting a side wall; and a face plate on which a phosphor screen is formed are positioned in a predetermined relationship and integrally assembled by means of frit glass. Thereafter, funnels within which electron guns are sealed are joined to the rear plate by means of frit glass, thereby obtaining a color cathode-ray tube.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color cathode-ray tube comprising:

an envelope having a substantially flat face plate, a side wall extending in a direction substantially perpendicular to a peripheral portion of the face plate, a substantially flat rear plate opposing the face plate, and a phosphor screen formed on an inner surface of the face plate;

beam emitting means mounted on the rear plate for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen; and positioning means for positioning the face plate and the shadow mask with respect to the rear plate, the positioning means having a positioning member and an engaging portion, the positioning member being provided at the envelope and the engaging portion being provided at the shadow mask, the engaging portion engaging the positioning member.

2. A color cathode-ray tube comprising:

an envelope having a substantially flat face plate, a side wall extending in a direction substantially perpendicular to a peripheral portion of the face plate, a substantially flat rear plate opposing the face plate, and a phosphor screen formed on an inner surface of the face plate;

beam emitting means mounted on the rear plate for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen; and positioning means for positioning the face plate and the shadow mask with respect to the rear plate, the positioning means having a positioning member and an engaging portion, the positioning member being provided at the envelope and the engaging portion being provided at the shadow mask the engaging portion engaging the positioning member, wherein said positioning means has a first positioning member extending from the rear plate toward the face plate, and a second positioning member extending from the face plate and fitted with the first positioning member.

3. A color cathode-ray tube according to claim 2, wherein said first positioning member has an extended end in which a positioning recess is formed, and said second positioning member has an extended end fitted in the positioning recess.

4. A color cathode-ray tube according to claim 3, wherein said phosphor screen has a large number of phosphor layers aligned in a predetermined direction, and said positioning recess is formed into an elongated shape extending in the predetermined direction.

5. A color cathode-ray tube comprising an envelope having a substantially flat face plate, a side wall extending in a direction substantially perpendicular to a peripheral portion of the face plate, a substantially flat rear plate opposing the face plate, and a phosphor screen formed on an inner surface of the face plate;

beam emitting means mounted on the rear plate for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen; and positioning means for positioning the face plate and the shadow mask with respect to the rear plate, the positioning means having a positioning member and an engaging portion, the positioning member being provided at the envelope and the engaging portion being provided at the shadow mask the engaging portion engaging the positioning member, wherein said engaging portion has an opening in which the positioning member is inserted.

6. A color cathode-ray tube according to claim 5, wherein the opening has an elongated shape.

7. A color cathode-ray tube comprising:

an envelope having a substantially flat face plate, a side wall extending in a direction substantially perpendicular to a peripheral portion of the face plate, a substantially flat rear plate opposing the face plate, and a phosphor screen formed on an inner surface of the face plate;

beam emitting means mounted on the rear plate for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen;

positioning means for positioning the face plate and the shadow mask with respect to the rear plate, the positioning means having a positioning member and an engaging portion, the positioning member being provided at the envelope and the engaging portion being provided at the shadow mask the engaging portion engaging the positioning member; and a plate-like fixing member fixed to the rear plate, and wherein said mask support means are fixed to the fixing member.

8. A color cathode-ray tube comprising:

an envelope having a substantially flat face plate, a side wall extending in a direction substantially perpendicular to a peripheral portion of the face plate, a substantially flat rear plate opposing the face plate, and a phosphor screen formed on an inner surface of the face plate;

beam emitting means mounted on the rear plate for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen; and positioning means for positioning the face plate and the shadow mask with respect to the rear plate;

the shadow mask including an effective region including the electron beam passage apertures, and a separation portion for separating an engaging portion which engages with the positioning means from the shadow mask, the separation portion being provided at a portion of the shadow mask which is outside the effective region.

9. A color cathode-ray tube comprising:

an envelope having a substantially flat face plate, a side wall extending in a direction substantially perpendicular to a peripheral portion of said face plate, a substantially flat rear plate opposing the face plate, and a phosphor screen formed on an inner surface of the face plate;

beam emitting means mounted on the rear plate for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen; and positioning means provided at the inner surface of the face plate for positioning the face plate with respect to the rear plate, the phosphor screen being formed in a predetermined positional relationship with the positioning means.

10. A color cathode-ray tube comprising:

an envelope having a substantially flat face plate, a side wall extending in a direction substantially perpendicular to a peripheral portion of said face plate, a substantially flat rear plate opposing the face plate, and a phosphor screen formed on an inner surface of the face plate;

beam emitting means mounted on the rear plate for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen; and positioning means provided at the inner surface of the face plate for positioning the face plate with respect to the rear plate, the phosphor screen being formed in a predetermined positional relationship with the positioning means, wherein said positioning means has a reference mark formed on the inner surface of the face plate in a predetermined positional relationship with the phosphor screen, and a positioning member fixed to the inner surface of the face plate at a predetermined position with respect to the reference mark.

11. A color cathode-ray tube according to claim 10, wherein said positioning means has a fixing member fixed to the inner surface of said face plate near the reference mark, and said positioning member is fixed to the fixing member.

12. A color cathode-ray tube according to claim 10, wherein said positioning means includes a support member which has an opening formed in correspondence with the reference mark and is fixed to the face plate in a state that the opening is aligned with the reference mark, and said positioning member is fixed to the support member at a predetermined position with respect to the opening.

13. A color cathode-ray tube according to claim 12, wherein said positioning means has a fixing member fixed to the inner surface of the face plate near the reference mark, and the support member is fixed to the fixing member.

14. A color cathode-ray tube comprising:

an envelope having a substantially flat face plate, a side wall extending in a direction substantially perpendicular to a peripheral portion of said face plate, a substantially flat rear plate opposing the face plate, and a phosphor screen formed on an inner surface of said face plate;

beam emitting means mounted on the rear plate, for emitting electron beams for dividedly scanning a plurality of regions of the phosphor screen;

a shadow mask arranged in the envelope, the shadow mask facing the phosphor screen and having a plurality of electron beam passage apertures;

mask support means provided at the rear plate for supporting the shadow mask at a predetermined distance from the phosphor screen;

first positioning means for positioning the shadow mask with respect to the rear plate, the first positioning means being provided on the rear plate and engaged with the shadow mask; and second positioning means for positioning the face plate with respect to the rear plate, the second positioning means having a reference mark formed on the inner surface of the face plate in a predetermined positional relationship with the phosphor screen, and a positioning member mounted on the inner surface of the face plate at a predetermined position with respect to the reference mark.

* * * * *